US007712512B2

(12) United States Patent
Suganuma et al.

(10) Patent No.: US 7,712,512 B2
(45) Date of Patent: May 11, 2010

(54) METHOD FOR MANUFACTURING COMPOSITE METAL MATERIAL AND METHOD FOR MANUFACTURING COMPOSITE-METAL MOLDED ARTICLE

(75) Inventors: Masashi Suganuma, Nagano (JP); Tomoyuki Sato, Nagano (JP); Atsushi Kato, Nagano (JP)

(73) Assignee: Nissei Plastic Industrial Co., Ltd. (JP)

( * ) Notice: Subject to any disclaimer, the term of this patent is extended or adjusted under 35 U.S.C. 154(b) by 387 days.

(21) Appl. No.: 11/818,798

(22) Filed: Jun. 16, 2007

(65) Prior Publication Data

US 2008/0159906 A1 Jul. 3, 2008

(30) Foreign Application Priority Data

Jun. 15, 2006 (JP) ..... 2006-166701

(51) Int. Cl.
*B22D 27/09* (2006.01)

(52) U.S. Cl. ..... 164/113; 900/97

(58) Field of Classification Search ..... 164/91, 164/97, 113, 120, 461, 900
See application file for complete search history.

(56) References Cited

U.S. PATENT DOCUMENTS 6,860,314 B1 * 3/2005 Koide et al. ..... 164/113

FOREIGN PATENT DOCUMENTS

JP 2004136363 5/2004
JP 2004176244 6/2004

* cited by examiner

*Primary Examiner*—Jessica L. Ward
*Assistant Examiner*—Kevin E Yoon
(74) *Attorney, Agent, or Firm*—Adams & Wilks

(57) ABSTRACT

A method for manufacturing a composite metal material combined with a nanocarbon material comprises heating a metal alloy to a half-melted state in which both liquid and solid phases are present. Next, a nongraphitized nanocarbon material is added to the half-melted metal alloy and stirred to form a composite metal material combined with a nanocarbon.

6 Claims, 2 Drawing Sheets

METHOD FOR MANUFACTURING COMPOSITE METAL MATERIAL AND METHOD FOR MANUFACTURING COMPOSITE-METAL MOLDED ARTICLE

FIELD OF THE INVENTION

The present invention relates to a method for manufacturing a composite metal material that includes a nanocarbon material, and to a method for manufacturing a composite-metal molded article.

BACKGROUND OF THE INVENTION

Composite metal materials are obtained by mixing single-walled carbon nanotubes, multi-walled carbon nanotubes, nanocarbon fiber, fullerenes, or other nano-sized carbon materials (referred to below as "nanocarbon materials") into metal alloys. Composite metal materials are thought to be capable of having enhanced mechanical and thermal properties relative to simple metal alloys.

However, nanocarbon materials have poor wettability in relation to metal alloys. The two materials will therefore separate if a nanocarbon material is simply stirred together with a metal alloy. Once separation has occurred, a composite metal material having the desired mechanical and thermal properties will not be able to be obtained. Techniques for preventing separation have already been proposed in, e.g., Japanese Patent Laid-Open Publication No. 2004-136363 (JP-A-2004-136363).

In claim 1 of JP-A-2004-136363, there is defined the invention "a method for molding a composite of a nanocarbon material and a metal alloy having a low melting point, comprising: cooling the melted metal alloy having a low melting point so that a liquid phase and a solid phase coexist and a thixotropic half-melted state is obtained; mixing the metal alloy having a low melting point and the nanocarbon material in this state and making a composite material; maintaining the thixotropy of the composite material and injecting the composite 1 material to fill a mold using a molding machine provided with heating means; and molding a composite metal article using the mold."

In other words, a nanocarbon material is mixed into a metal alloy in a state in which both liquid and solid phases are present, and movement of the nanocarbon material is therefore limited. Since movement is limited, the nanocarbon material will not float up or precipitate out, and improvements in dispersibility can be achieved.

However, the metal alloy does not adhere to the nanocarbon material. Gaps may arise between the metal alloy and the nanocarbon material when repeated loads are applied to the composite metal material. When gaps arise, the mechanical and thermal properties deteriorate.

Further improvements in wettability have been needed as a counter measure, because the metal alloy can be made to adhere to the nanocarbon material if the wettability is good.

Techniques for further improving wettability have been proposed in, e.g., Japanese Patent Laid-Open Publication No. 2004-176244 (JP-A-2004-176244).

JP-A-2004-176244 is characterized in that a nanocarbon material to be added to a metal matrix is graphitized.

In order to verify the technique of JP-A-2004-176244, the present inventors performed an experiment for obtaining composite-metal molded articles in which a graphitized nanocarbon material was mixed into a metal alloy. The conditions and results of the experiment are as below.

Materials:

Metal alloy: ASTM AZ91D (magnesium alloy die-cast, equivalent to JISH 5303 MDC1D). The composition of a material specified as AZ91D is approximately 9% by mass of Al, 1% by mass of Zn, with the remainder being Mg and small amounts of other elements and unavoidable impurities.

Nanocarbon material: Graphitized nanocarbon material.

Mixing ratio: Shown in the following table.

Stirring: Three to five hours with a stirrer.

Injection Molding:

Size of the mold cavity:

JIS 5 piece(65-mm length×27-mm width×3-mm thickness)

Injector type: Metal molding machine

Injection pressure: 20 MPa

Melting temperature: 590 to 600° C.

Injection rate: 1.5 m/s

Tensile Testing Machine:

Testing machine made by Shimadzu Corporation (AUTOGRAPH AG-250KNIS)

The tensile yield strengths (the value defined by JIS K7113 as "the tensile stress at the first point on a load/elongation curve at which an increase in length is recognized without an increase in load") obtained using the tensile testing machine are shown in Table 1 below.

TABLE 1

| | Composite material | | |
|---|---|---|---|
| Sample No. | AZ91D | Graphitized nanocarbon material | Tensile yield strength |
| Sample 1 | 100% | 0% | 190 MPa |
| Sample 2 | 99.9% | 0.1% | 190.2 MPa |
| Sample 3 | 99.5% | 0.5% | 191 MPa |
| Sample 4 | 99.0% | 1.0% | 192 MPa |
| Sample 5 | 98.5% | 1.5% | 206 MPa |
| Sample 6 | 98.3% | 1.7% | 198 MPa |
| Sample 7 | 98.0% | 2.0% | 192 MPa |

The test piece in Sample 1 was manufactured using only AZ91D (magnesium alloy). The tensile yield strength was 190 MPa.

The test piece in Sample 2 was manufactured by mixing 0.1% by mass of nanocarbon material into 99.9% by mass of AZ91D (magnesium alloy). The tensile yield strength was 190.2 MPa.

The test pieces in Samples 3 and 4 were manufactured by mixing 0.5% and 1.0% by mass of nanocarbon material into 99.5% and 99.0% by mass of AZ91D (magnesium alloy). The tensile yield strengths were 191 MPa and 192 MPa.

The test piece in Sample 5 was manufactured by mixing 1.5% by mass of nanocarbon material into 98.5% by mass of AZ91D (magnesium alloy). The tensile yield strength was 206 MPa.

The test pieces in Samples 6 and 7 were manufactured by mixing 1.7% and 2.0% by mass of nanocarbon material into 98.3% and 98.0% by mass of AZ91D (magnesium alloy). The tensile yield strengths were 198 MPa and 192 MPa.

The tensile yield strength obtained using Sample 1 (190 MPa) will be used as a standard. Since the goal of adding a nanocarbon material and making a composite is to improve strength, an improvement in strength of at least 5%, and preferably 10% or more, is expected. 190 MPa (Sample 1)

multiplied by a factor of 1.05 is 200 MPa, and 190 MPa (Sample 1) multiplied by a factor of 1.1 is 210 MPa.

The results were that Samples 2 through 4, 6, and 7 were less than 200 MPa. Sample 5 exceeded 200 MPa but was less than 210 MPa.

It should be noted that nanocarbon materials are extremely expensive.

The tensile yield strengths of Samples 2 through 7 are too low for the proportions of expensive nanocarbon material that were mixed. A technique that can yield a stronger molded article is needed to make effective use of expensive nanocarbon material.

The present inventors once again investigated graphitized nanocarbon materials, the use of which has become common knowledge. Specifically, nanocarbon materials are composed of regular six-membered rings (annular structures composed of six carbon atoms) or five-membered rings (annular structures composed of five carbon atoms). Nanocarbon materials having few defects can be obtained by graphitization. However, wettability is poor when graphitized materials having few defects are combined with a metal. The graphitized nanocarbon material may be further processed in order to resolve this drawback, but manufacturing costs will increase in proportion to the number of additional steps.

The present inventors therefore devoted themselves to developing a manufacturing method for providing a high-strength metal-composite molded article without raising manufacturing costs.

The inventors first observed the surface of a graphitized nanocarbon material using scanning electron microscopy (SEM). This revealed that the surface of the graphitized nanocarbon material is smooth. A further analysis using an X-ray diffraction apparatus revealed that the graphitized nanocarbon material has high crystallinity. Since it is smooth and has high crystallinity, the graphitized nanocarbon material is assumed to have low wettability with metal alloys. It is presumed that bonding between the metal alloy and the nanocarbon material will be incomplete if wettability is low, and improving strength will be difficult.

In order to improve wettability, the inventors observed a nongraphitized nanocarbon material using scanning electron microscopy while investigating various techniques for processing the surface of the nanocarbon material. The surface of the nongraphitized nanocarbon material was recognized as being rough. A further analysis using an X-ray diffraction apparatus revealed that the nanocarbon material is amorphous.

The strength of the nongraphitized nanocarbon material is low. Hence, such nongraphtized nanocarbon materials had not been considered as reinforcing materials. However, since they are amorphous and their surfaces are rough, such nongraphitized nanocarbon materials are assumed to have high wettability and their bondability with a metal alloy is expected to be adequate.

Adequately high strength was obtained when a nongraphitized nanocarbon material was stirred together with a metal alloy in accordance with the perspective above. This has lead to the present invention as summarized below.

SUMMARY OF THE INVENTION

According to a first aspect of the present invention, there is provided a method for manufacturing a composite metal material combined with a nanocarbon, which method comprises the steps of: heating a metal alloy to a half-melted state in which both liquid and solid phases are present; and adding a nongraphitized nanocarbon material to the half-melted metal alloy and stirring to obtain a composite metal material combined with a nanocarbon.

In other words, a material that has not yet been graphitized was used as the nanocarbon material. Nongraphitized nanocarbon materials have good wettability and form proper bonds with metal alloys. As a result, a high-strength composite molded articled can be obtained.

Preferably, a composition of the composite metal material is 0.3% to 2.0% by mass of the nanocarbon material, with the remainder being the metal alloy.

The necessary strength can be obtained if the ratio of nanocarbon material is 0.3% to 2.0% by mass.

A composition of the composite metal material is preferably 0.6% to 1.6% by mass of the nanocarbon material, with the remainder being the metal alloy. A high strength can be obtained if the ratio of nanocarbon material is 0.6% to 1.6% by mass.

A composition of the composite metal material is preferably 1.0% to 1.5% by mass of the nanocarbon material, with the remainder being the metal alloy. An extremely high strength can be obtained if the ratio of nanocarbon material is 1.0% to 1.5% by mass.

According to a second aspect of the present invention, there is provided a method for manufacturing a composite-metal molded article in which a molded article is obtained from a composite metal material combined with a nanocarbon material, the method comprising the steps of: heating a metal alloy to a half-melted state in which both liquid and solid phases are present; adding a nongraphitized nanocarbon material to the half-melted metal alloy and stirring to obtain a composite metal material combined with a nanocarbon; and feeding the resulting composite metal material directly to a metal molding machine and performing molding in the half-melted state using a cavity of a mold to form a composite-metal molded article.

A composite-metal molded article is manufactured using a composite metal material having high wettability. The mechanical and thermal properties of the resulting composite-metal molded article can be enhanced. Since the composite metal material is fed directly to a metal molding machine, production efficiency increases, and productivity can be increased. Large-scale production can be facilitated due to the high productivity.

According to a third aspect of the present invention, there is provided a method for manufacturing a composite-metal molded article in which a molded article is obtained from a composite metal material combined with a nanocarbon material, the method comprising the steps of: heating a metal alloy to a half-melted state in which both liquid and solid phases are present; adding a nongraphitized nanocarbon material to the half-melted metal alloy and stirring to obtain a composite metal material combined with a nanocarbon; cooling the resulting composite metal material and making a solid composite metal material; and feeding the solid composite metal material to a metal molding machine, heating to the half-melted state, and performing molding using a cavity of a mold to form a composite-metal molded article.

A composite-metal molded article is manufactured using a composite metal material having high wettability. The mechanical and thermal properties of the resulting composite-metal molded article can be enhanced. The composite metal material is stored in a solid form, and the solid composite metal material can be fed to a metal molding machine when necessary. As a result, the degree of freedom of production increases, which is particularly ideal for small-scale production.

BRIEF DESCRIPTION OF THE DRAWINGS

Certain preferred embodiments of the present invention will be described in detail below, by way of example only, with reference to the accompanying drawings, in which.

DESCRIPTION OF THE PREFERRED EMBODIMENTS

Figure 1:
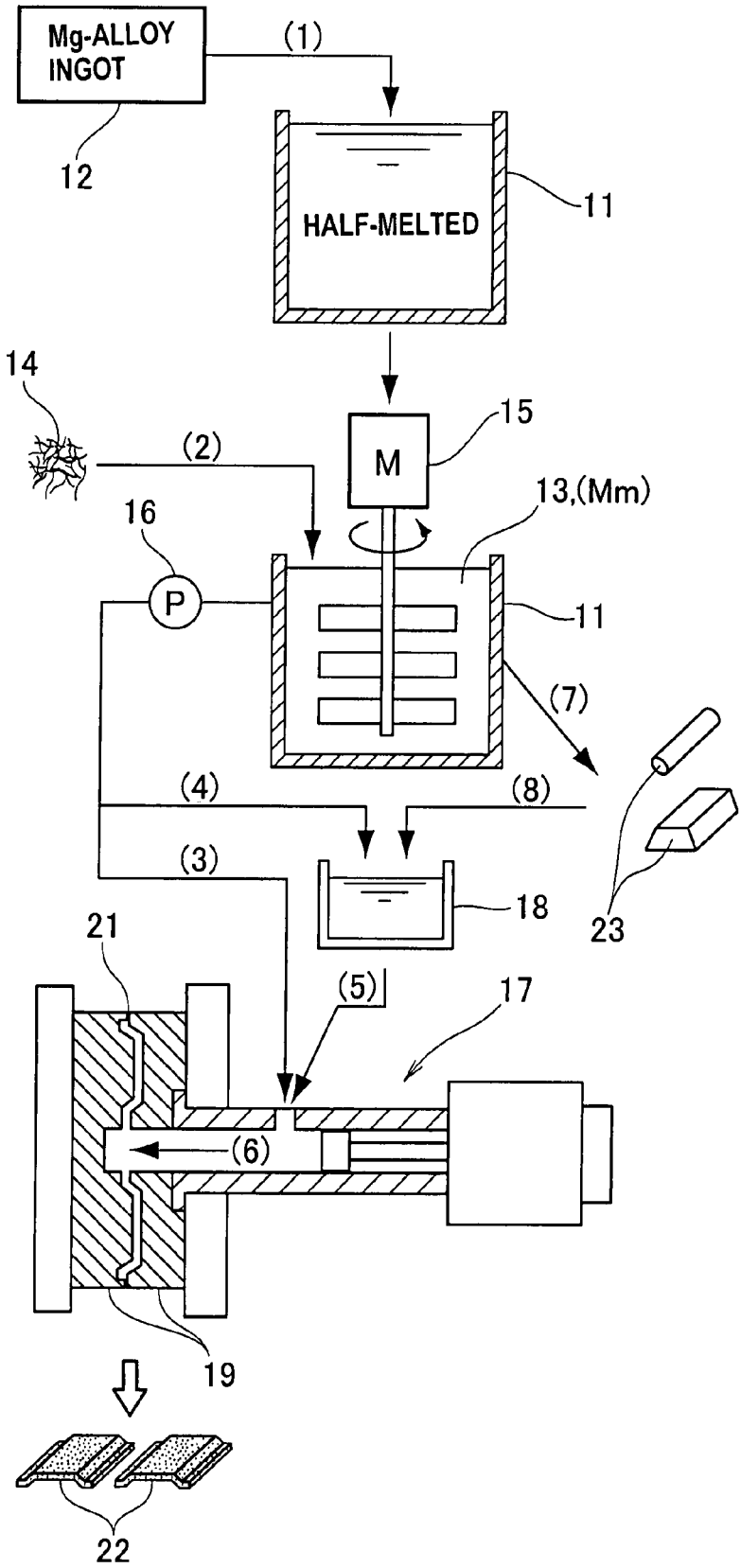
FIG. 1 is a flow chart of the manufacture of a composite metal material and a composite-metal molded article according to the present invention.

The manufacturing flow of the composite metal material and the composite-metal molded article according to the present invention will be described on the basis of FIG. 1.

First, a Mg-alloy ingot 12 is put into a crucible 11, as shown by the arrow (1). Heating is then performed in the crucible 11 until a half-melted state is reached.

A nongraphitized nanocarbon material 14 is then put into a half-melted metal alloy 13, as shown by the arrow (2), and stirred using a stirrer 15. The nanocarbon material 14 is thereby dispersed into the liquid-phase portions of the metal alloy 13. A mixture (composite metal material) Mm can thereby be obtained.

The mixture (composite metal material) Mm is fed directly to a die-casting machine or other metal molding machine 17 using pumping means 16, as shown by the arrow (3). The mixture (composite metal material) Mm may also be temporarily stored in an insulated container 18 at this point, as shown by the arrow (4), and then fed to the metal molding machine 17, as shown by the arrow (5). Although the route of the arrows (4) and (5) involves the insulated container 18, the mixture (composite metal material) Mm remains in the half-melted state and can therefore be fed directly to the metal molding machine 17 as in the route of arrow (3).

The half-melted mixture (composite metal material) Mm is then provided to the cavity 21 of a mold 19, as shown by the arrow (6), and nanocarbon composite-metal molded articles 22, 22 are obtained.

Hot rolling or hot extruding is then performed on the nanocarbon composite-metal molded articles 22, whereby the metal structure is refined, and the mechanical and thermal properties can be improved.

The manufacturing method described above is called the "direct molding method," because the half-melted mixture (composite metal material) Mm is continuously sent to the mold 19. The direct molding method has high production capacity and allows the manufacture nanocarbon composite-metal molded articles at low cost, but since changing materials and the like is difficult, this method is suited for large-scale production of a small variety of products.

Alternatively, the half-melted mixture (composite metal material) Mm removed from the crucible 11 can be temporarily cooled and made into a solid mixture 23, as shown by the arrow (7). The solid mixture 23 can be preserved and stored as needed.

The solid mixture 23 is heated to the half-melted temperature and stored in the insulated container 18 in a half-melted state when needed (arrow (8)). The mixture is then fed to the mold 19 using the metal molding machine 17, and the nanocarbon composite-metal molded articles 22, 22 are obtained.

The manufacturing method described above is called the "indirect molding method," because the half-melted mixture (composite metal material) Mm is sent to the mold 19 in a non-continuous manner. The indirect molding method does not have high production capacity, but the degree of freedom of production is high, and this method is ideal for small-scale production of a wide variety of products.

EXPERIMENTAL EXAMPLES

Experimental examples according to the present invention will be described below. The present invention is not limited to the experimental examples. Throughout the specification, the term "nongraphitized nanocarbon" should be construed as "nanocarbon before graphitization".

Materials:

Metal alloy: ASTM AZ91D (magnesium alloy die-cast, equivalent to JISH 5303 MDC1D).

Nanocarbon material: Nongraphitized nanocarbon material.

Mixing ratio: Shown in the following table.

Stirring: Three to five hours in a stirrer.

Injection Molding:

Size of the mold cavity: JIS5 piece (65-mm length×27-mm width×3-mm thickness)

Injector type: Metal molding machine

Injection pressure: 20 MPa

Melting temperature: 590 to 600° C.

Injection rate: 1.5 m/s

Tensile Testing Machine:

Testing machine made by Shimadzu Corporation (AUTOGRAPH AG-250KNIS)

The tensile yield strengths (the value defined by JIS K7113 as "the tensile stress at the first point on a load/elongation curve at which an increase in length is recognized without an increase in load") obtained using the tensile testing machine are shown in Table 2. The sample numbers are 11 through 17.

TABLE 2

| | Composite material | | |
|---|---|---|---|
| Sample No. | AZ91D | Non-graphitized nanocarbon material | Tensile yield strength |
| Sample 11 | 100% | 0% | 190 MPa |
| Sample 12 | 99.9% | 0.1% | 196 MPa |
| Sample 13 | 99.5% | 0.5% | 218 MPa |
| Sample 14 | 99.0% | 1.0% | 229 MPa |
| Sample 15 | 98.5% | 1.5% | 228 MPa |
| Sample 16 | 98.3% | 1.7% | 214 MPa |
| Sample 17 | 98.0% | 2.0% | 205 MPa |

The test piece in Sample 11 was manufactured using only AZ91D (magnesium alloy). The tensile yield strength was 190 MPa.

The test piece in Sample 12 was manufactured by mixing 0.1% by mass of nanocarbon material (nongraphitized nanocarbon material, the same hereinafter) into 99.9% by mass of AZ91D (magnesium alloy). The tensile yield strength was 196 MPa.

The test pieces in Samples 13 and 14 were manufactured by mixing 0.5% and 1.0% by mass of nanocarbon material into 99.5% and 99.0% by mass of AZ91D (magnesium alloy). The tensile yield strengths were 218 MPa and 229 MPa.

The test pieces in Samples 15 and 16 were manufactured by mixing 1.5% and 1.7% by mass of nanocarbon material into 98.5% and 98.3% by mass of AZ91D (magnesium alloy). The tensile yield strengths were 228 MPa and 214 MPa.

The test piece in Sample 17 was manufactured by mixing 2.0% by mass of nanocarbon material into 98.0% by mass of AZ91D (magnesium alloy). The tensile yield strength was 205 MPa.

The tensile yield strengths shown in Table 2 have been represented in the form of a graph so as to be more readily understandable.

Figure 2:
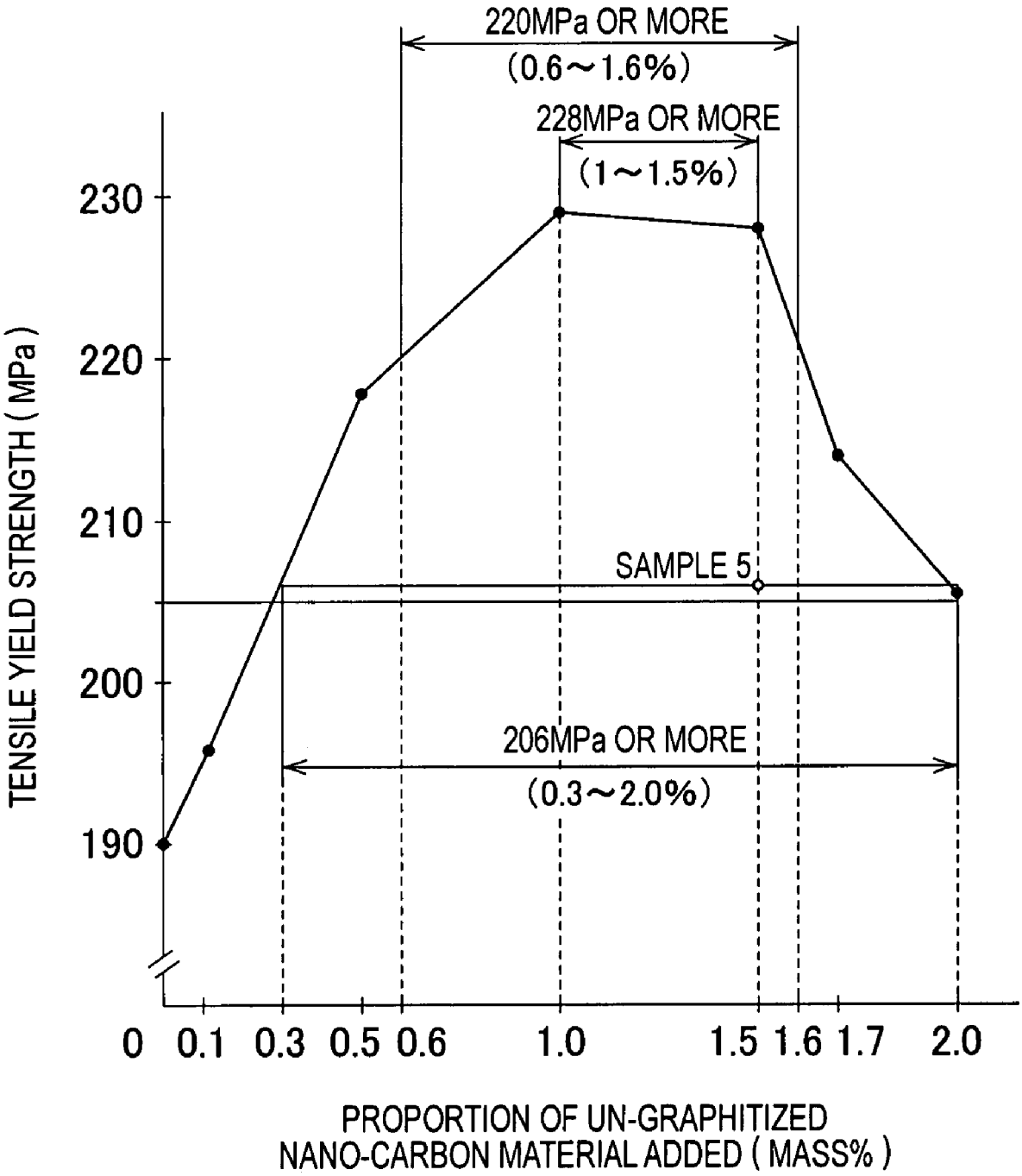
FIG. 2 is a graph showing a relationship between the amount of nongraphitized nanocarbon material added and the tensile yield strength.

FIG. 2 is a graph that shows the relationship between the amount of nongraphitized nanocarbon material added and the tensile yield strength according to the present invention. Sample 5 exhibited the highest strength in the prior art described in Table 1. Sample 5 (206-MPa tensile yield strength) is shown by the horizontal line in the graph.

According to the graph of FIG. 2, a strength equal to or greater than Sample 5 can be obtained when the proportion of nongraphitized nanocarbon material added is in the range of 0.3% to 2.0% by mass.

A high strength of 220 MPa or more can be obtained if the proportion of nongraphitized nanocarbon material added is in the range of 0.6% to 1.6% by mass.

An extremely high strength of 228 MPa or more can be obtained if the proportion of nongraphitized nanocarbon material added is in the range of 1.0% to 1.5% by mass.

As is made clear from the description above, a high-strength composite-metal molded article can be obtained by employing a nongraphitized nanocarbon material as the nanocarbon material. The reason is thought to be that nongraphitized nanocarbon material has good wettability and bonds properly with the metal alloy.

The metal alloy may also be an Al alloy instead of a Mg alloy.

Obviously, various minor changes and modifications of the present invention are possible in light of the above teaching. It is therefore to be understood that within the scope of the appended claims the invention may be practiced otherwise than as specifically described.

What is claimed is:

1. A method for manufacturing a composite metal material combined with a nanocarbon material, the method comprising the steps of:

heating a metal alloy to a half-melted state in which both liquid and solid phases are present; and adding a nongraphitized nanocarbon material to the half-melted metal alloy and stirring to obtain a composite metal material combined with a nanocarbon.

2. The method of claim 1, wherein a composition of the composite metal material is 0.3% to 2.0% by mass of the nanocarbon material, with the remainder being the metal alloy.

3. The method of claim 1, wherein a composition of the composite metal material is 0.6% to 1.6% by mass of the nanocarbon material, with the remainder being the metal alloy.

4. The method of claim 1, wherein a composition of the composite metal material is 1.0% to 1.5% by mass of the nanocarbon material, with the remainder being the metal alloy.

5. A method for manufacturing a composite-metal molded article in which a molded article is obtained from a composite metal material combined with a nanocarbon material, the method comprising the steps of:

heating a metal alloy to a half-melted state in which both liquid and solid phases are present;

adding a nongraphitized nanocarbon material to the half-melted metal alloy and stirring to obtain a composite metal material combined with a nanocarbon; and feeding the resulting composite metal material directly to a metal molding machine and performing molding in the half-melted state using a cavity of a mold to form a composite-metal molded article.

6. A method for manufacturing a composite-metal molded article in which a molded article is obtained from a composite metal material combined with a nanocarbon material, the method comprising the steps of:

heating a metal alloy to a half-melted state in which both liquid and solid phases are present;

adding a nongraphitized nanocarbon material to the half-melted metal alloy and stirring to obtain a composite metal material combined with a nanocarbon;

cooling the resulting composite metal material and making a solid composite metal material; and feeding the solid composite metal material to a metal molding machine, heating to the half-melted state, and performing molding using a cavity of a mold to form a composite-metal molded article.

* * * * *